US011642895B2

(12) United States Patent
Shibata

(10) Patent No.: US 11,642,895 B2
(45) Date of Patent: May 9, 2023

(54) HANDY PRINTER

(71) Applicant: KYOCERA Document Solutions Inc., Osaka (JP)

(72) Inventor: Yukio Shibata, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/652,544

(22) Filed: Feb. 25, 2022

(65) Prior Publication Data

US 2022/0281230 A1 Sep. 8, 2022

(30) Foreign Application Priority Data

Mar. 8, 2021 (JP) ..... JP2021-036013

(51) Int. Cl.
*B41J 2/36* (2006.01)
*B41J 2/21* (2006.01)
*B41J 3/36* (2006.01)

(52) U.S. Cl.
CPC ..... *B41J 2/36* (2013.01); *B41J 2/2135* (2013.01); *B41J 3/36* (2013.01)

(58) Field of Classification Search
CPC ..... B41J 2/36; B41J 3/36; B41J 2/2135; B41J 2/2132; B41J 2203/01; B41J 2/362; B41J 2/365; B41J 2/37
See application file for complete search history.

(56) References Cited

U.S. PATENT DOCUMENTS 6,172,688 B1 * 1/2001 Iwasaki ..... B41J 3/4075 347/2
2016/0052300 A1 * 2/2016 Ueshima ..... B41J 2/21 347/16
2018/0113407 A1 * 4/2018 Takahashi ..... G03G 15/5054

FOREIGN PATENT DOCUMENTS

JP 2016093925 A 5/2016

* cited by examiner

*Primary Examiner* — Kristal Feggins
(74) *Attorney, Agent, or Firm* — Alleman Hall Creasman & Tuttle LLP

(57) ABSTRACT

A print processing portion causes a print device to execute printing of a print image based on print data in accordance with a first scanning amount detected when manual scanning is performed at a first time. A density complementation processing portion causes the print processing portion to execute reprinting in accordance with a second scanning amount detected when the manual scanning is performed at at least a second time. When the manual scanning is performed at at least the second time, the density complementation processing portion identifies density insufficient parts in the print image printed by the print device based on the scanning amount and an image read by an optical reading device. Furthermore, the density complementation processing portion causes the print processing portion to execute the reprinting for the density insufficient parts.

5 Claims, 3 Drawing Sheets

HANDY PRINTER

INCORPORATION BY REFERENCE

This application is based upon and claims the benefit of priority from the corresponding Japanese Patent Application No. 2021-036013 filed on Mar. 8, 2021, the entire contents of which are incorporated herein by reference.

BACKGROUND

The present disclosure relates to a handy printer.

There may be a case where the conventional manual scanning type handy printer clears image data of pixels for which an ink ejection operation has been performed. In this case, in manual scanning performed at a plurality of times, the conventional handy printer does not perform ink ejection again for the pixels for which the ink ejection operation has been performed.

SUMMARY

A handy printer according to the present disclosure is a handy printer which prints a print image while moving by manual scanning. The handy printer includes: a print device, a scanning detection portion, an optical reading device, a print processing portion, and a density complementation processing portion. The print device performs printing onto a recording medium. The scanning detection portion detects a scanning amount of the manual scanning. The optical reading device optically reads an image in the recording medium and generates a read image. The print processing portion causes the print device to execute printing of the print image based on print data in accordance with a first scanning amount detected when the manual scanning is performed at a first time. The density complementation processing portion causes the print processing portion to perform reprinting in accordance with a second scanning amount detected when the manual scanning at at least a second time is performed. When the manual scanning at at least the second time is performed, the density complementation processing portion identifies density insufficient parts in the print image printed by the print device based on the scanning amount and the image read by the optical reading device. Furthermore, the density complementation processing portion causes the print processing portion to execute the reprinting for the density insufficient parts.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, with reference to the accompanying drawings, an embodiment of the present disclosure will be described.

Figure 1:
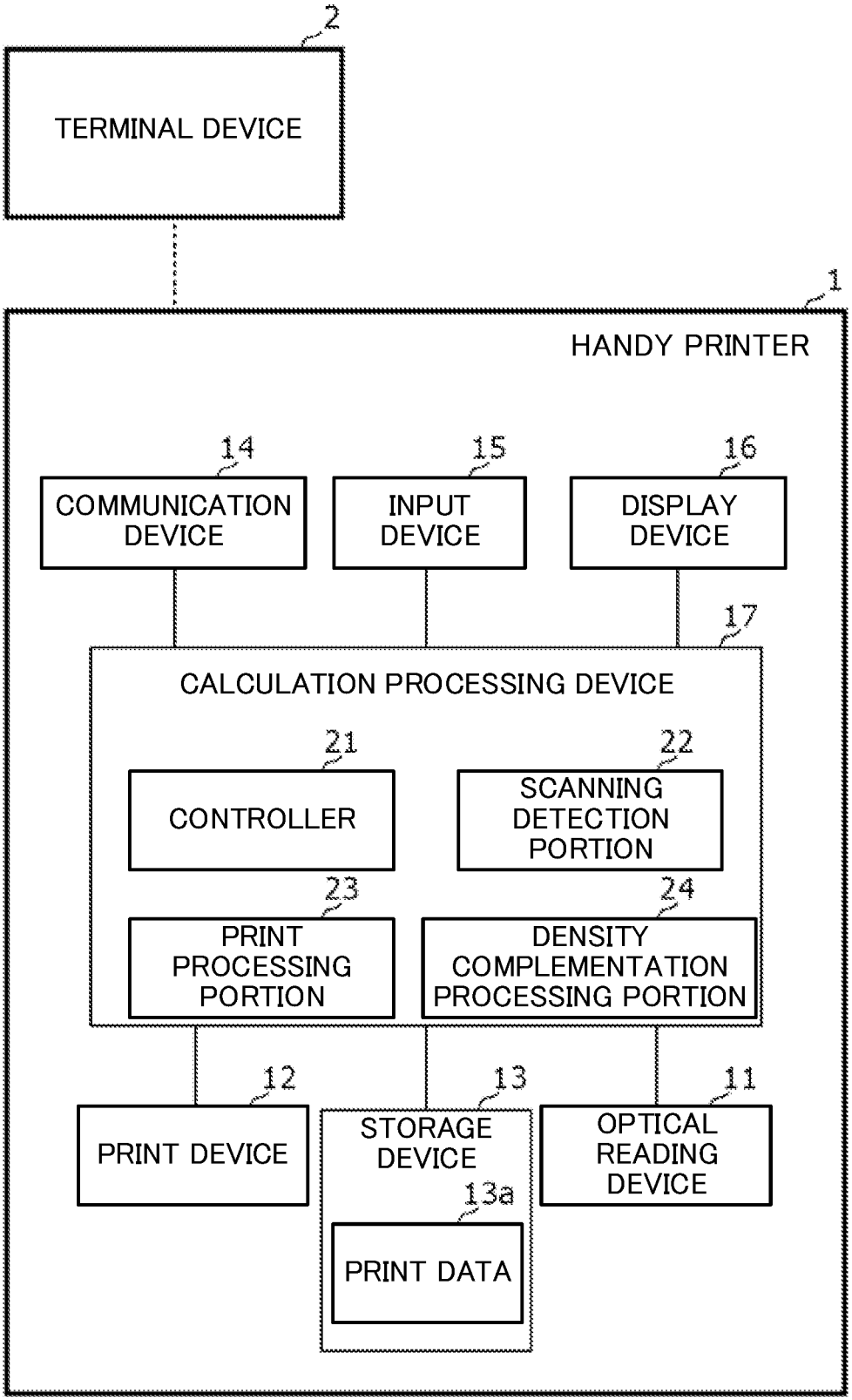
FIG. 1 is a block diagram showing a configuration of a handy printer according to an embodiment of the present disclosure.

A handy printer 1 shown in FIG. 1 is a manual scanning type printer. The handy printer 1 prints a print image while moving by manual scanning.

The handy printer 1 shown in FIG. 1 includes an optical reading device 11, a print device 12, a storage device 13, a communication device 14, an input device 15, a display device 16, a calculation processing device 17, and the like inside a housing, not shown. The handy printer 1 operates by electrical power of, for example, a battery (a primary battery or a secondary battery) inside the housing.

The optical reading device 11 is disposed along a bottom surface of the housing inside the housing. The optical reading device 11 radiates light to a recording medium and detects reflected light from the recording medium. Thus, the optical reading device 11 optically reads an image formed on a surface of the recording medium and generates a read image. For example, the recording medium is paper, cloth, or the like. The image formed on the surface of the recording medium is an image of a material of the surface of the recording medium or a previously printed image. The read image generated by the optical reading device 11 is image data.

The print device 12 is disposed along the bottom surface of the housing inside the housing. The print device 12 is, for example, of an ink-jet type and prints a print image onto the recording medium. The print image includes characters, graphics, photographs, or the like.

Note that the print device 12 is disposed on an upstream side in a direction of the manual scanning with respect to the optical reading device 11.

The storage device 13 is a non-volatile storage device such as a flash memory. The storage device 13 stores data or a program. For example, a print data 13*a* or the like is stored in the storage device 13.

The communication device 14 is an interface device of a wired or wireless network. The communication device 14 performs data communication with a terminal device 2.

Note that the terminal device 2 is a personal computer, having a data communication function, or the like. The terminal device 2 executes a driver program, thereby transmitting the print data 13*a* of a print image desired by a user to the handy printer 1.

The input device 15 is disposed on the housing. The input device 15 is hard keys, a touch panel, or the like, which accepts a user operation. The display device 16 is disposed on the housing. The display device 16 is an indicator, a liquid crystal display, or the like, which displays various kinds of information to the user.

The calculation processing device 17 includes a computer having a central processing unit (CPU), a read only memory (ROM), a random access memory (RAM), and the like. The calculation processing device 17 loads a program stored in the ROM or the storage device 13 to the RAM.

The CPU executes the program, whereby the calculation processing device 17 operates as various kinds of processing portions. In the present embodiment, the calculation processing device 17 operates as a controller 21, a scanning detection portion 22, a print processing portion 23, and a density complementation processing portion 24. The controller 21, the scanning detection portion 22, the print processing portion 23, and the density complementation processing portion 24 are examples of the processing portions.

The controller 21 accepts the print data 13*a* of each print job requested by the terminal device 2 through the communication device 14. Furthermore, in accordance with predetermined user operation to the input device 15, the controller 21 causes the print processing portion 23 to start printing based on the print data 13*a*.

The user operation is, for example, pressing-down of a start key. The print data 13*a* includes image data of a print image and print setting. The print setting is, for example, a resolution, an image size, or the like.

The scanning detection portion 22 detects scanning amounts of the manual scanning. For example, the scanning amounts are movement distances of the handy printer 1 at predetermined time intervals.

In this embodiment, based on a change in an image obtained by the optical reading device 11, the scanning detection portion 22 detects the scanning amounts. For example, the scanning detection portion 22 detects the movement distances of an object, a pattern, or the like in a series of read images obtained by the optical reading device 11 at the predetermined time intervals as the scanning amounts. In addition, the scanning amounts may be an integrated value of movement speeds of the object or the pattern in the series of the read images.

Note that the scanning detection portion 22 may include a roller which is rotatable while contacting the recording medium. In this case, the scanning detection portion 22 measures a number of rotations or rotation speeds of the roller upon the manual scanning, thereby detecting the scanning amounts.

In accordance with the scanning amounts of the manual scanning and based on the print data 13*a*, the print processing portion 23 causes the print device 12 to execute printing of the print image. The scanning amount of the manual scanning is the scanning amount detected by the scanning detection portion 22 when the manual scanning is performed.

In the meantime, there may be a case where the conventional handy printer prints one document image by performing the manual scanning at a plurality of times. In this case, when a first ink ejection operation has been performed, it is likely that density insufficiency is caused on thin lines or the like.

In second and subsequent ink ejection operations, in a case where ink ejection for parts on which the density insufficiency has been caused is not performed, it is likely that favorable print image quality cannot be obtained.

On the other hand, the handy printer 1 includes a configuration to obtain the favorable print image quality.

(a) The density complementation processing portion 24 identifies density insufficient parts of the print image printed by the print device 12 based on an image read by the optical reading device 11. (b) Furthermore, the density complementation processing portion 24 causes the print processing portion 12 to execute reprinting for the density insufficient parts. Note that in the reprinting, reprinting for parts other than the density insufficient parts in the print image is not performed.

In first manual scanning, printing of the print image is executed. In second manual scanning, when the density insufficient parts in the print image are identified, immediately, reprinting for the density insufficient parts is executed.

Hereinafter, an object in the print image based on the print data 13*a* is referred to as a primary object G1 (see FIG. 2). On the other hand, an object in the read image is referred to as a secondary object G2 (see FIG. 2). The object is, for example, a character or the like.

In addition, the density complementation processing portion 24 identifies the primary object G1 in the print data 13*a* and identifies the secondary object G2 in the read image corresponding to the primary object G1. Furthermore, the density complementation processing portion 24 compares the primary object G1 and the secondary object G2 and identifies density insufficient parts G20 in the read image (see FIG. 2).

Figure 2:
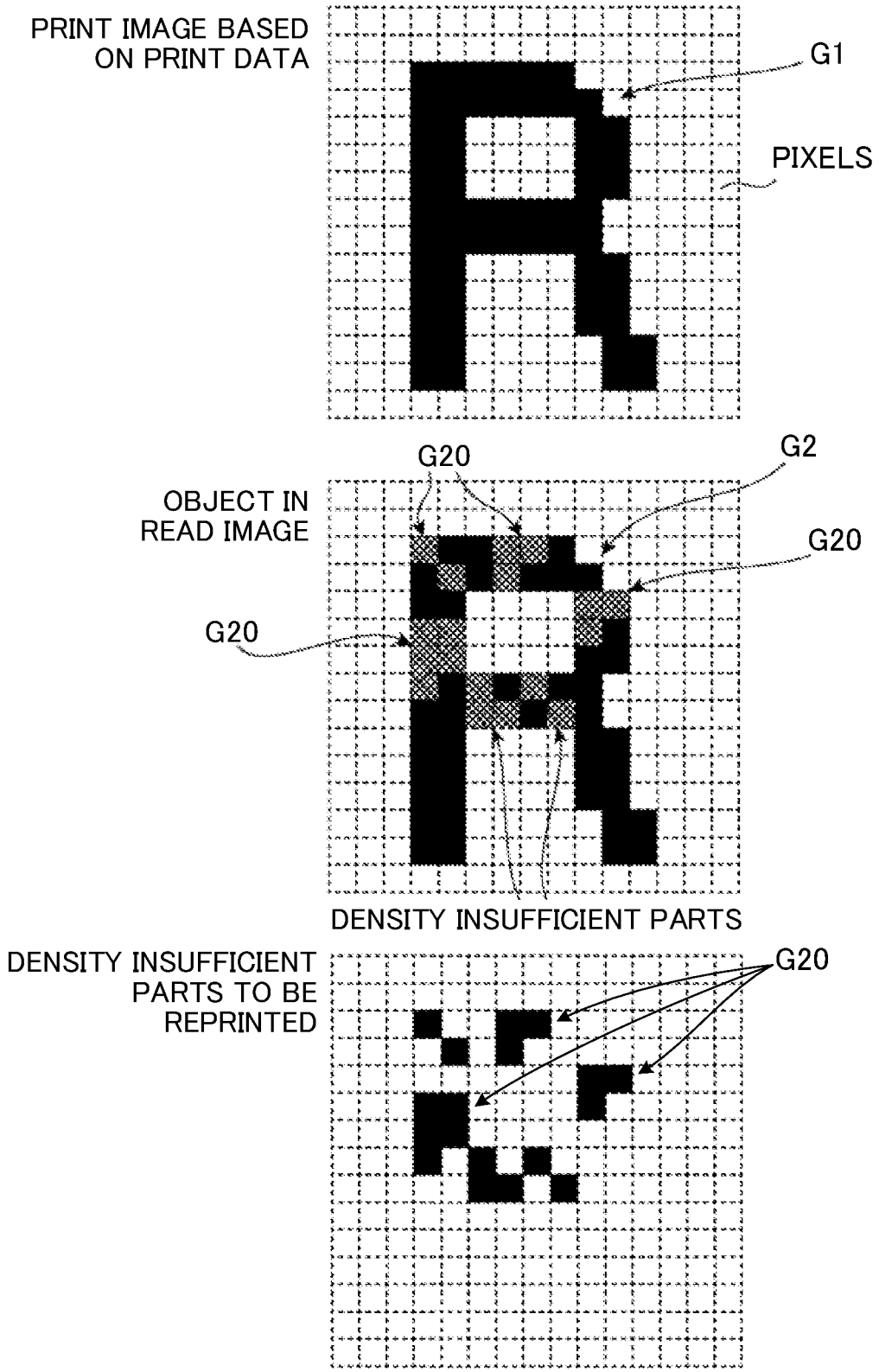
FIG. 2 is a diagram explaining density insufficient parts.

Specifically, for example, as shown in FIG. 2, the density complementation processing portion 24 detects the primary object G1 in the print image based on the print data 13*a*.

Furthermore, the density complementation processing portion 24 performs pattern matching of dot patterns between the detected primary object G1 and an image in an attention region corresponding to a magnitude of the primary object G1 in the print image.

Furthermore, in a case where matched parts whose rate is a predetermined rate or more are detected by the pattern matching, the density complementation processing portion 24 associates the primary object G1 with the image in the attention region. The image in the attention region associated with the primary object G1 is the secondary object G2.

Furthermore, as to pixels of the secondary object G2, the density complementation processing portion 24 derives differences in densities between the pixels of the secondary object G2 and pixels of the corresponding primary object G1.

Furthermore, the density complementation processing portion 24 identifies pixels whose each density difference exceeds a predetermined threshold value as the density insufficient parts G20

For example, the density complementation processing portion 24 edits the print data 13*a* so as to increase densities of the density insufficient parts G20.

On the other hand, in a case where the density insufficient parts G20 are parts which correspond to parts in a thin line image in the print image based on the print data, the density complementation processing portion 24 may edit the print data 13*a*. In this case, the density complementation processing portion 24 edits the print data 13*a* so as to increase line widths of the thin line image. Note that the thin line image is an image having line widths, each of which is a predetermined threshold value or less.

In addition, based on the above-described density differences, the density complementation processing portion 24 may edit the print data 13*a* such that densities of the density insufficient parts G20 after reprinting reach target densities. The target densities are densities of corresponding parts to cope with the density insufficient parts G20 in the print image based on the print data 13*a*. The corresponding parts are parts to cope with the density insufficient parts G20 in the read image.

Based on the print data after editing, the density complementation processing portion 24 causes the print processing portion 23 to execute reprinting as to the density insufficient parts G20.

Figure 3:
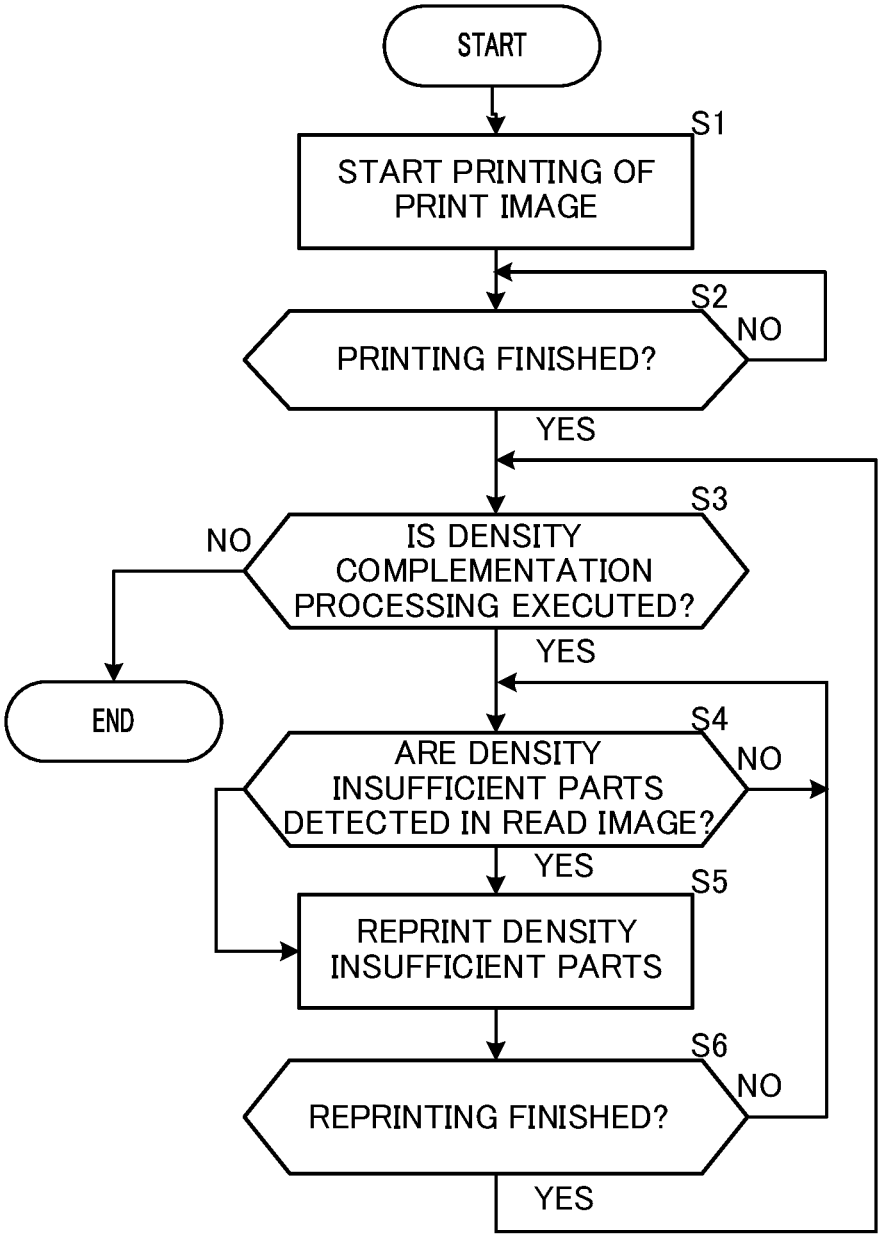
FIG. 3 is a flowchart explaining operations of the handy printer 1 shown in FIG. 1.

Next, with reference to a flowchart shown in FIG. 3, operations of the handy printer 1 will be described.

The user turns on a power source of the handy printer 1 and performs an operation to issue a print request to the terminal device 2. The operation of the print request includes an operation of selecting a desired print image.

In accordance with the driver program, the terminal device 2 automatically generates print data 13*a* as to the selected print image. Furthermore, in accordance with a predetermined communication protocol, the terminal device 2 transmits the print data 13*a* to the handy printer 1 (communication device 14). The print data 13*a* is transmitted as a request of a print job to the handy printer 1.

On the other hand, in the handy printer 1, the controller 21 uses the communication device 14 and receives the print data 13*a* from the terminal device 2. Furthermore, the controller 21 causes the storage device 13 to store the print data 13*a*.

Furthermore, when detecting the user operation to the input device 15, the controller 21 causes the print processing portion 23 to start a printing operation based on the print data 13*a* (step S1). Thus, printing of the print image is executed.

After starting the printing operation, the print processing portion 23 references the scanning amounts detected by the scanning detection portion 22. For example, the print processing portion 23 references the scanning amounts invariably or regularly at predetermined time intervals. Note that the scanning amount detected by the scanning detection portion 22 when the printing operation based on the print data 13*a* is executed is a first scanning amount.

In a case where a partial image of the print image is present in a current region of an image region of the print data 13*a*, the print processing portion 23 causes the print device 12 to execute processing in which the partial image is printed onto the recording medium. The current region is a region corresponding to a current position of the handy printer 1. Based on the scanning amounts, the print processing portion 23 identifies the current position.

Note that the current position of the handy printer 1 is a relative position from a print start position. For example, the print processing portion 23 integrates the first scanning amounts obtained at the predetermined time intervals, thereby identifying the current position.

When a predetermined finish operation is detected by the input device 15 or printing of the whole region of the print image is completed, the print processing portion 23 finishes the printing of the print image (step S2).

After completing the printing, the density complementation processing portion 24 displays an inquiry message on the display device 16 or the terminal device 2 (step S3). The inquiry message is a message inquiring of the user whether the density complementation processing is executed.

After confirming the inquiry message, the user performs a response operation indicating whether the density complementation processing is executed to the input device 15 or the terminal device 2. The density complementation processing portion 24 detects the response operation to the terminal device 2 or the input device 15. Furthermore, in accordance with the response operation, the density complementation processing portion 24 determines whether the density complementation processing is executed (step S3).

In a case where it is determined that the density complementation processing is executed, when the next manual scanning is started, the density complementation processing portion 24 executes processing in which density insufficient parts G20 are detected (step S4). The density complementation processing portion 24 repeatedly determines whether the density insufficient parts G20 are detected (step S4). The scanning amount detected by the scanning detection portion 22 when the density complementation processing is executed is a second scanning amount. The density complementation processing portion 24 identifies the current position and positions of the density insufficient parts G20 by integrating the second scanning amounts.

When the density insufficient parts G20 are detected, the density complementation processing portion 24 causes the print processing portion 23 to execute the reprinting for the detected density insufficient parts G20 (step S5).

When the predetermined finish operation is detected by the input device 15 or the manual scanning is completed, the print processing portion 23 finishes the reprinting for the density insufficient parts G20 (step S6).

When the reprinting for the density insufficient parts G20 is completed, the density complementation processing portion 24 returns the processing to step S3. Thus, the density complementation processing portion 24 displays the above-described inquiry message again. Each time the response operation indicating that the density complementation processing is executed is detected, the density complementation processing portion 24 executes the reprinting for the density insufficient parts G20.

As described above, according to the above-described embodiment, the optical reading device 11 optically reads the image in the recording medium and generates the read image. The print processing portion 23 causes the print device 12 to execute the printing of the print image in accordance with the scanning amounts of the manual scanning and based on the print data.

Based on the image read by the optical reading device 11, the density complementation processing portion 24 identifies the density insufficient parts G20 in the print image printed by the print device 12. Furthermore, the density complementation processing portion 24 causes the print processing portion 23 to execute the reprinting for the density insufficient parts G20.

The print image on the recording medium is complemented by the reprinting for the density insufficient parts G20, thereby obtaining the favorable print image quality.

Note that various changes and modifications to the above-described embodiment are apparent to those having ordinary skill in the art. Such changes and modifications may be made without departing from the spirit and scope of the subject matter and weakening intended advantages. In other words, such changes and modifications are intended to be embraced within the scope of the appended claims.

For example, in the above-described embodiment, the print device 12 may be an ink-jet type color print device. The color print device performs printing by ejecting a plurality of colors of ink.

In a case where the above-described print image is a color image based on the plurality of colors, the density complementation processing portion 24 may identify the above-described density insufficient parts G20 separately as to each of the plurality of colors. In this case, the density complementation processing portion 24 causes the print processing portion 12 to execute the printing for the density insufficient parts G20 as to each of the plurality of colors by using kinds of ink, which correspond to the colors.

In addition, in the above-described embodiment, when the reprinting for the density insufficient parts G20 is performed, the print processing portion 23 may cause the print device 12 to perform ink ejection by using an alternative nozzle. The alternative nozzle is a nozzle which is different from a nozzle used for the density insufficient parts G20 when the printing of the print image is performed.

The present disclosure is applicable to, for example, a handy printer.

It is to be understood that the embodiments herein are illustrative and not restrictive, since the scope of the disclosure is defined by the appended claims rather than by the description preceding them, and all changes that fall within metes and bounds of the claims, or equivalence of such metes and bounds thereof are therefore intended to be embraced by the claims.

The invention claimed is:

1. A handy printer which prints a print image while moving by manual scanning, the handy printer comprising:

a print device configured to perform printing onto a recording medium;

a scanning detection portion configured to detect a scanning amount of the manual scanning;

an optical reading device configured to optically read an image in the recording medium and to generate a read image;

a print processing portion configured to cause the print device to execute printing of the print image based on print data in accordance with a first scanning amount detected when the manual scanning is performed at a first time; and a density complementation processing portion configured to cause the print processing portion to perform reprinting in accordance with a second scanning amount detected when the manual scanning at at least a second time is performed, wherein when the manual scanning at at least the second time is performed, the density complementation processing portion identifies density insufficient parts in the print image printed by the print device based on the scanning amount and the image read by the optical reading device, and the density complementation processing portion further causes the print processing portion to execute the reprinting for the density insufficient parts.

2. The handy printer according to claim 1, wherein the density complementation processing portion identifies a primary object which is an object in the print image based on the print data and a secondary object which is an object in the read image corresponding to the primary object, and by comparing the primary object and the secondary object, the density complementation processing portion further identifies the density insufficient parts.

3. The handy printer according to claim 1, wherein the density complementation processing portion edits the print data so as to increase densities of the density insufficient parts, and based on the print data after editing, the density complementation processing portion further causes the print processing portion to execute the reprinting for the density insufficient parts.

4. The handy printer according to claim 1, wherein in a case where the density insufficient parts are parts which correspond to parts in a thin line image in the print image based on the print data, the density complementation processing portion edits the print data so as to increase line widths of the thin line image, and based on the print data after editing, the density complementation processing portion further causes the print processing portion to execute the reprinting for the density insufficient parts.

5. The handy printer according to claim 1, wherein the print device performs the printing by ejecting a predetermined plurality of colors of ink, in a case where the print image is a color image based on the plurality of colors, the density complementation processing portion identifies the density insufficient parts as to each of the plurality of colors, and the density complementation processing portion further causes the print processing portion to execute the reprinting for the density insufficient parts as to each of the plurality of colors by using corresponding colors of ink.

* * * * *